US006364704B1

(12) United States Patent
Godefroy

(10) Patent No.: US 6,364,704 B1
(45) Date of Patent: Apr. 2, 2002

(54) SEALED ELECTRICAL CONNECTOR, PROVIDED WITH A FRONT GRILL FOR LOCKING CONTACTS

(75) Inventor: Alban Godefroy, Epernon (FR)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/733,542

(22) Filed: Dec. 8, 2000

(30) Foreign Application Priority Data

Dec. 8, 1999 (FR) ..... 99 15475

(51) Int. Cl.[7] ..... H01R 13/40
(52) U.S. Cl. ..... 439/589
(58) Field of Search ..... 439/587, 589, 439/349, 350, 351, 352

(56) References Cited

U.S. PATENT DOCUMENTS 5,634,807 A * 6/1997 Saito ..... 439/275
5,782,658 A * 7/1998 Maegawa et al. ..... 439/595
5,871,373 A * 2/1999 Pacini et al. ..... 439/587
6,132,252 A * 10/2000 Chaillot ..... 439/595

FOREIGN PATENT DOCUMENTS

| | | |
|---|---|---|
| DE | 3633358 A1 | 4/1988 |
| EP | 0330436 B1 | 8/1989 |
| EP | 0691708 A1 | 1/1996 |
| EP | 0691711 A1 | 1/1996 |

* cited by examiner

*Primary Examiner*—Tulsidas Patel
(74) *Attorney, Agent, or Firm*—Perman & Green, LLP

(57) ABSTRACT

A sealed electrical connector is disclosed including a central body and a peripheral skirt separated from each other by a throat having a joint disposed in the throat. The connector includes a frontal piece forming a front grill. The grill includes a frontal plate having at least one hole adapted to permit the passage of contacts of a male plug, the frontal grill covering the central body and having means for supporting the joint in the throat, the means being integrated within the contour of the central body.

10 Claims, 6 Drawing Sheets

SEALED ELECTRICAL CONNECTOR, PROVIDED WITH A FRONT GRILL FOR LOCKING CONTACTS

BACKGROUND OF THE INVENTION

1. Field of the Invention

Figure 2:
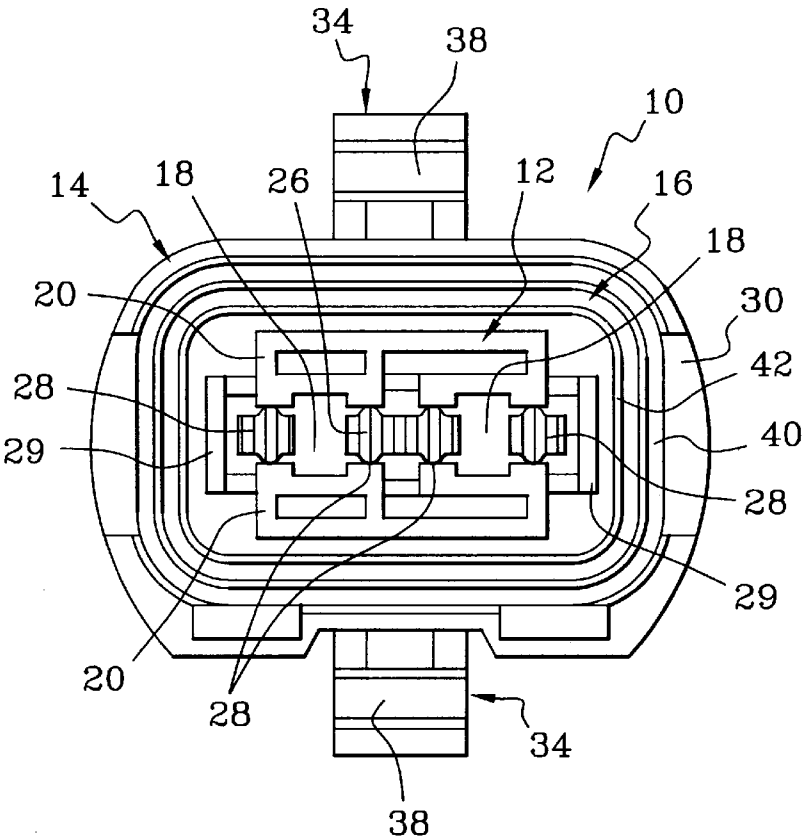

The present invention relates to a sealed electrical connector, and more particularly to a sealed electrical connector provided with a front grill for locking electrical contacts received in the connector.

2. Description of the Prior Art

There are known connectors in which one of the elements, generally the female portion, comprises a sealing joint provided to be interposed between this female portion and the male portion after plugging in and locking.

The problem of these joints is holding them in place, either in the housing of the connector in question before mounting, or after mounting when, for specific needs, the two portions of the connector must be disconnected. Such a case is encountered for example by diagnostic sockets for vehicles.

Thus, during disconnection, the joint can remain partially pressed against the withdrawn male connector which involves the joint being out of its recess and often leads to loss of this joint before remounting.

The connector can for this reason be subject to premature wear and lead to breakdown by loss of the initial sealing or by unlocking.

There is known from the patent application DE-A-36 33 358 a female connector which comprises a body into which the contacts are introduced and immobilized by a resilient catch with the holding of the contacts in a retained position by a member movable along the insertion axis of the connector.

The female contacts are introduced into the electrical connector and each contact receives, in a suitable recess, a catch which is free to retract under the introduction pressure of the contacts. The movable member is then moved to lock each catch in the snap-in position on the contact, which prevents retraction of this contact.

This female contact is also provided with a flat sealing joint disposed parallel to the plug-in axis, or in the form of a sleeve, about a wall which encircles the contacts. This sleeve comprises projecting sealing paths to come to bear against the internal surface of the male plug and on the external surface of the wall which surrounds the contacts to ensure interfacial sealing between the parallel walls of the male and female plugs.

The movable member also ensures immobilization as to translation, of this sleeve, about the wall which carries it, by coming into partial bearing relation on said sleeve.

The patent application EP-A-330 436 discloses a connector with an arrangement substantially identical to the preceding, but the movable member is different in that it comprises a peripheral cover which forms at the same time a guide for the male plugs during introduction.

Sealing is effected by a sleeve with a sealing surface of revolution, oriented parallel to the plug-in axis. On the contrary, this sleeve remains free and is not maintained in position by any member.

There is also known from the patent application EP-A-691 708 a monobloc connector with a frame provided with wings which are to be inserted in a space provided between the recesses for reception of the contacts. There is however no frontal grill provided with holes for the passage of contacts.

Patent application EP-A-691 711 discloses a connector in two parts, with a principal body receiving the rear of contacts and an internal peripheral joint and a secondary body with the front portion of the contacts which are received in the principal body. This connector has a sealing property but without the presence of a front grill.

SUMMARY OF THE INVENTION

The present invention relates to a sealed electrical connector which comprises a sealing joint, particularly with a sealing plane perpendicular to the axis of plugging in, a front grill which avoids retraction of the joint in case of dismounting or before the first plugging in, protections of the locking catches as well as means for positioning by pre-insertion and by insertion of the front grill.

To this end, the present invention provides a sealed connector which comprises a central body with a front grill provided with holding means of a sealing joint which are integrated into the central body, with no projecting element.

DETAILED DESCRIPTION OF THE DRAWINGS

Figure 1:
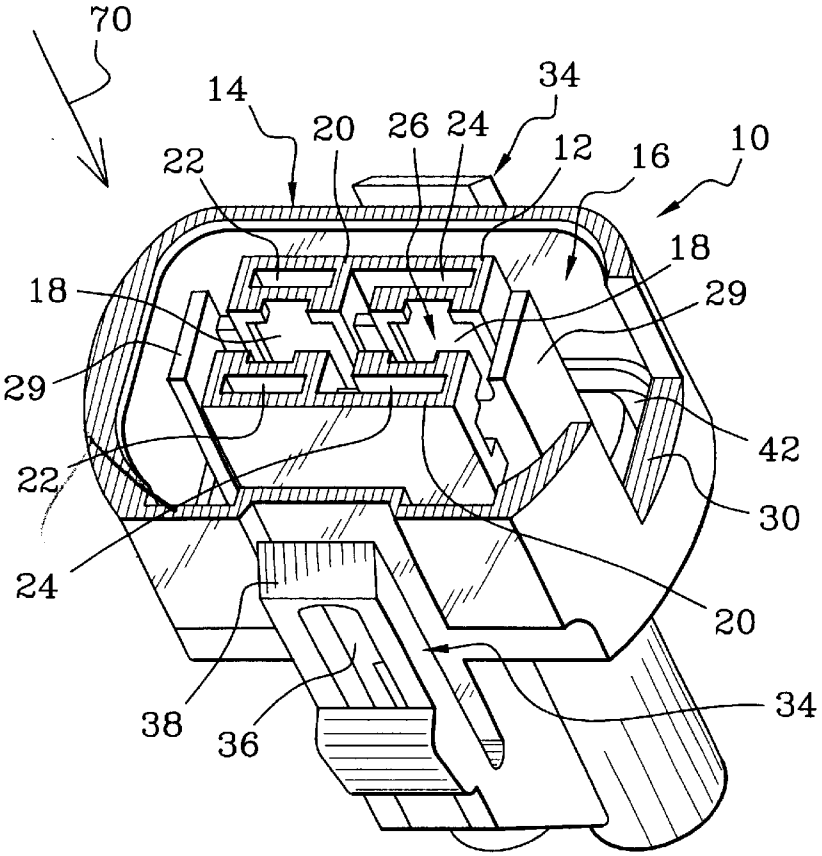

The present invention will now be described with respect to the accompanying drawings, which show a particular non-limiting example of a sealed electrical connector and the different figures concerned:

FIG. 1, a perspective view of a connector according to the invention with a sealing joint, FIG. 2, a top plan view of this same connector, FIG. 3, a top plan view of the connector joint according to the invention, FIG. 4, a perspective view of this same joint, FIG. 5, the front grill of the connector according to the present invention, seen in perspective, FIG. 6, a view of this grill, still in perspective, but seen from below, FIG. 7, a view of an electrical contact provided to be introduced into the connector, FIGS. 8A and 8B, side elevational views of the connector with the front grill in position before and after introduction, FIGS. 9A and 9B, cross-sectional views corresponding to views 8A and 8B, and FIGS. 10A and 10B, side cross-sectional views in two perpendicular directions, of a complete connector with a plug, after connection.

DETAILED DESCRIPTION OF THE PREFERRED EMBODIMENTS

In FIGS. 1 and 2, the connector 10 comprises a central body 12, a peripheral skirt 14 separated from said body by a throat 16.

The central body 12, of substantially rectangular shape in the embodiment in question, comprises recesses 18, in this instance two in number, of a cross-section suitable to receive an electrical contact.

These recesses have two thick walls 20; disposed on opposite sides of these recesses in which are also provided blind holes 22 and 24.

Along a median line parallel to the thick walls, the central block has a central passageway 26 in which are disposed two pairs of catches 28.

Perpendicular to these two walls, beyond the catches, the central block is provided with two protective covers 29, formed by molding with the central block.

The peripheral skirt 14 is disposed about the central block, at a constant distance, so as to provide a throat 16 of constant dimensions.

One of the walls of this skirt comprises recesses 30 forming a corrector to receive the male plug as will be explained later on.

On opposite sides of this skirt, snap-in connection means 32 are also made by molding with the skirt. These means comprise a resilient tongue 34 with a window 36 and an upper beveled portion 38.

Figure 3:
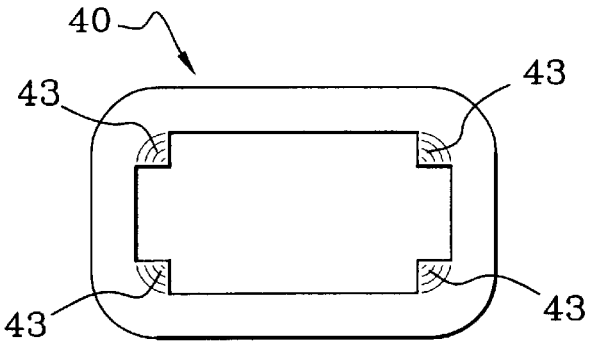
Figure 4:
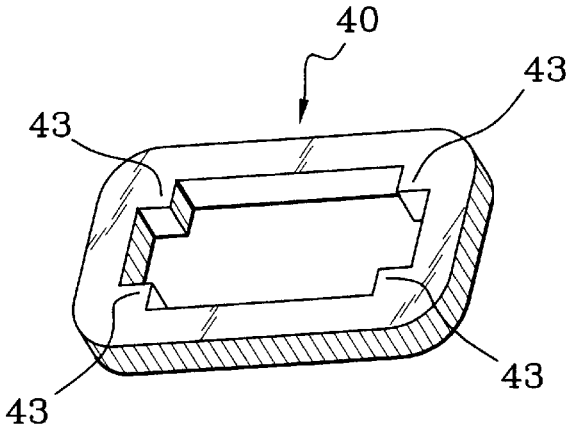

The throat 16 is provided to receive a joint represented in FIGS. 3 and 4. This flat joint has a rectangular shape to fit about the central block 12 and within the skirt 14, in this throat 16. A groove 42 is provided in the bottom of this throat to permit deformation of the joint.

This joint has the particularity of being shaped with internal angles which are prolonged in the form of angular sectors to form bearing regions 43.

Figure 5:
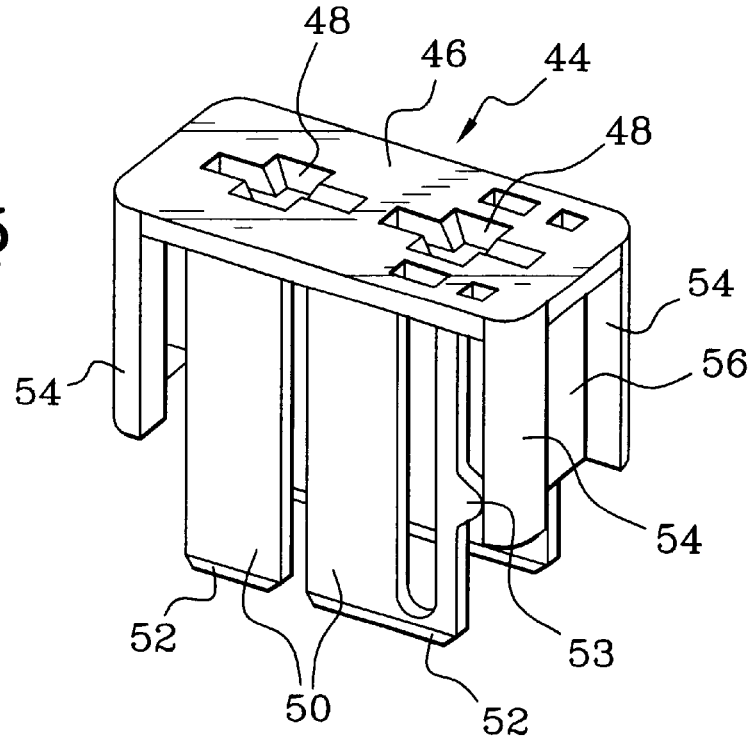
Figure 6:
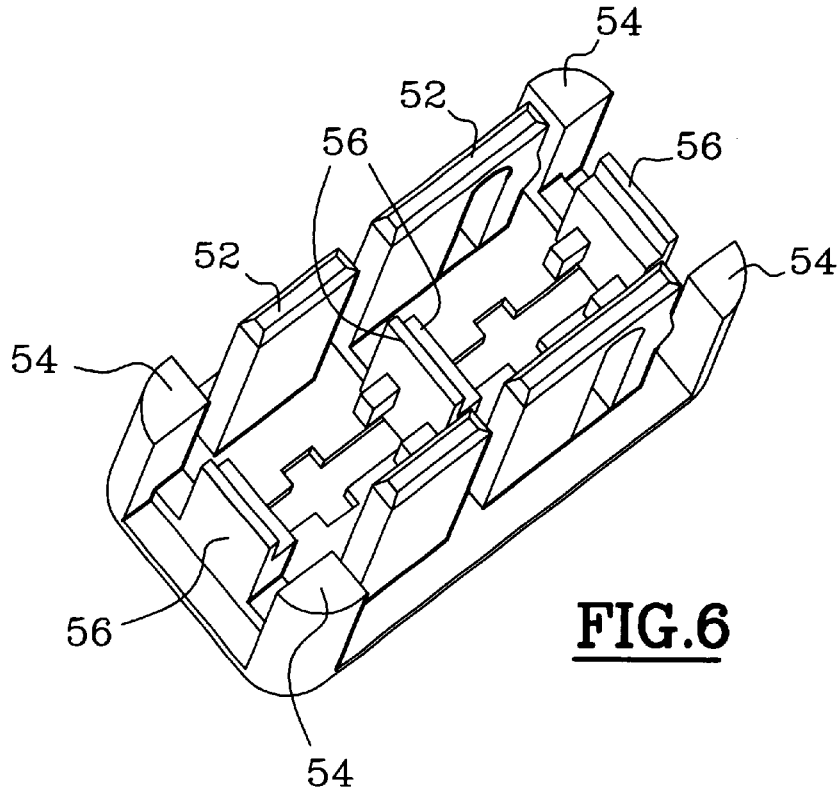

FIGS. 5 and 6 permit understanding the shapes and profiles of the frontal member forming the front grill 44. This grill comprises on the top, a frontal plate 46 which is provided with two passage holes 48 for the contacts of a male plug.

This plate has dimensions and cutouts which permit it to cover all of the central body, without extending beyond, to form a substantially continuous external contour.

On opposite sides of this frontal plate extend guide blades 50 having a bevelled end 52 to facilitate introduction.

These blades also carry positioning means 53 for pre-insertion and insertion. These means comprise, in the illustrated embodiment, a snap-in tooth 53-1, projecting from a resiliently deformable portion of the blade. This tooth can coact with suitable recesses 53-2 and 53-3, provided at two heights in the wall facing holes 22 and 24.

From this same frontal plate and at four corners extend four bearing tongues 54, whose profile has a section identical to the angular sectors of the bearing zones 43 of the joint 40.

From the central portion of this frontal plate and to coincide with the central passageway 26, extend locking fingers 56, four in number, as well as catches 28.

Figure 7:
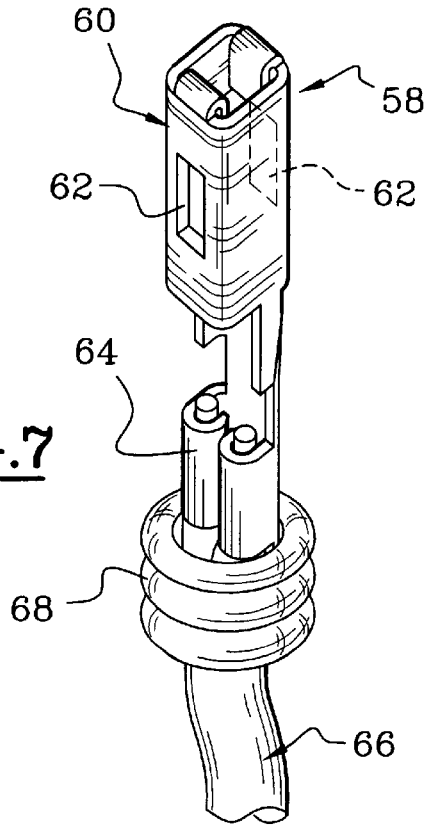
Figure 8B:
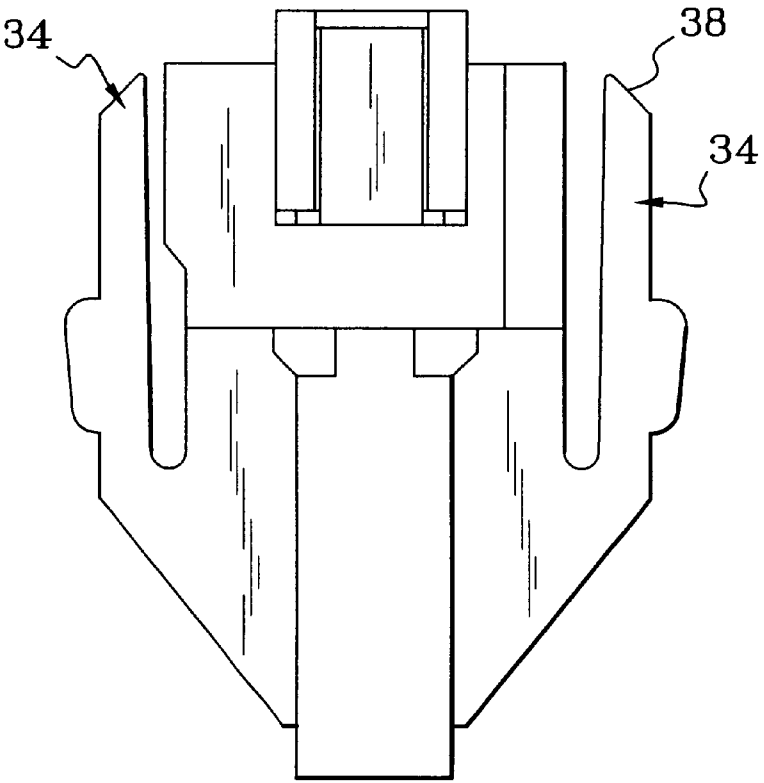

In FIG. 7, there is shown schematically a contact 58, of known type, with a cage 60 provided with two openings 62, with tongues 64 for gripping the cable 66, and with a sealing joint 68 with pads.

The preparation of the connector is carried out by practicing the following steps.

The connector receives, at the bottom of the throat 16, a joint 40, in this instance a flat joint, which covers the groove 42.

This joint comes into line with the junction of the central body with the bottom of the throat 16 by its internal side and in line with the internal surface of the skirt 14 by its exterior plate.

The bearing regions 43 of this joint are received in recesses, of conjugated profile, which result from the junction between the central block 12 and each protective cover 29.

Then the central body 12, formed by molding, is provided with the front grill which is disposed in the pre-insertion position in which the tooth 53-1 coacts with the recess 53-2.

This sealed connector receives two contacts, such as 58, each introduced into a recess 18 of the central block. These contacts come into abutment in the recesses 18 and in this position the openings 62 come to face the locking catches 28.

The joint 68 of each contact ensures sealing against the penetration of projections or of foreign bodies, by the lower portion of the central body.

The front grill 44 is then moved into the insertion position by pressing and each tooth 53-1 clicks into the recess 53-3 in the lower position.

By translation in the direction of plugging in, symbolized by the arrow 70, the front grill ensures, by complete insertion, several functions. First, the locking fingers 56 act against the catches and press them against the contacts by penetrating a recess, made at the same time as the catch, in the openings 62, which immobilizes in translation the contacts in their recesses 18. The two central fingers bear one against the other to generate a suitable overpressure, whilst the end fingers bear on the internal surface of the protective covers 29. The protection of the end catches will be seen to take place by these covers.

Figure 8A:
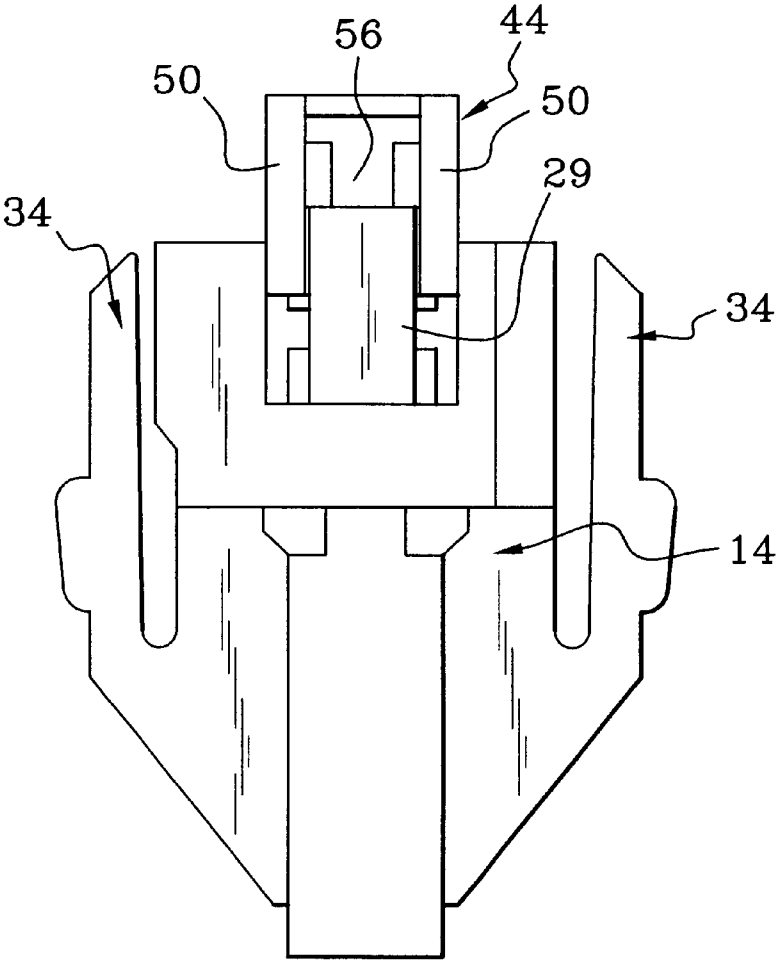
Figure 9A:
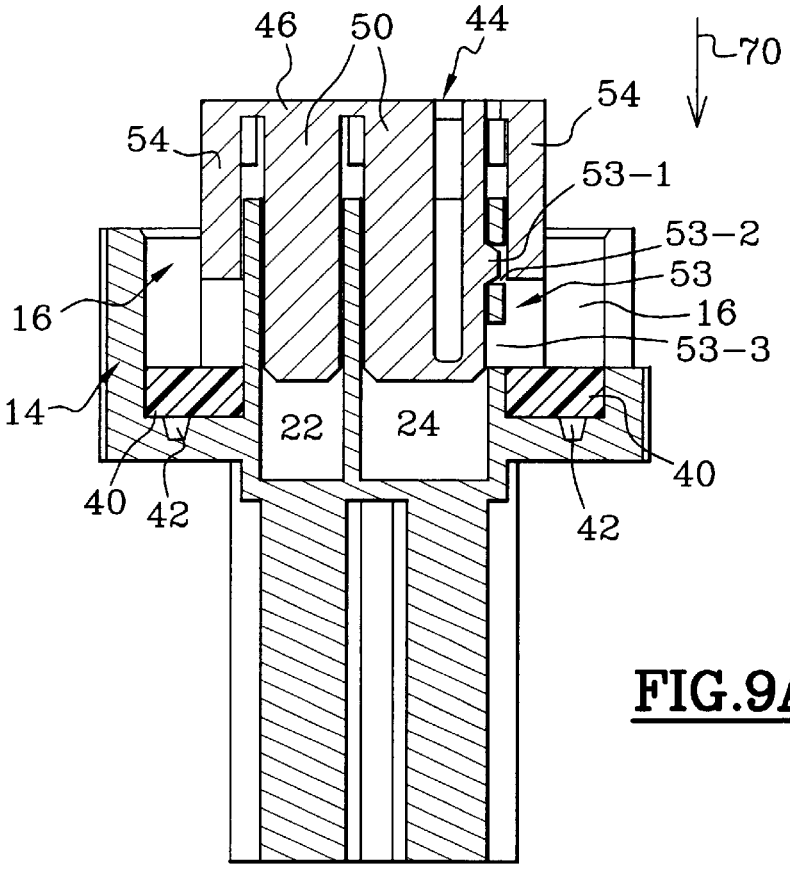

The four bearing tongues 54 will also slide in the corresponding angles formed by the intersections of the central body 12 and the protective covers 29, this step being visible particularly in FIGS. 8A and 9A.

The front grill having been totally inserted, has been displaced in translation until the front plate 46 comes into abutment against the central body, more particularly along the height of the thick walls 20.

Figure 9B:
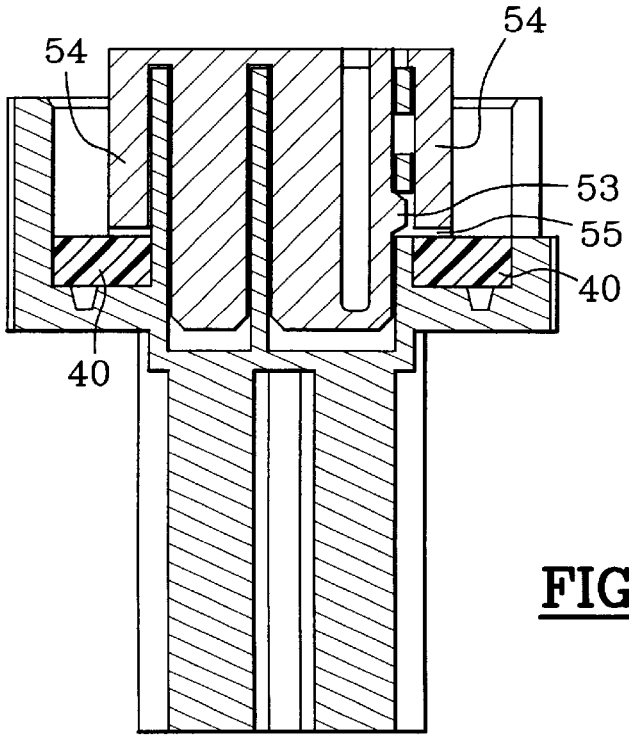

In this position, the bearing tongues 54, as shown in FIG. 9B, are located immediately above the joint 40, generating an expansion space 55, which avoids blocking it and permits it to undergo certain deformations without giving rise to movement of the front grill.

It will be noted that the central body forms a continuous assembly with the front grill, without projecting elements, neither along its periphery, nor along the top. Thus, the four bearing tongues are integrated into the contour of the central body.

Figure 10B:
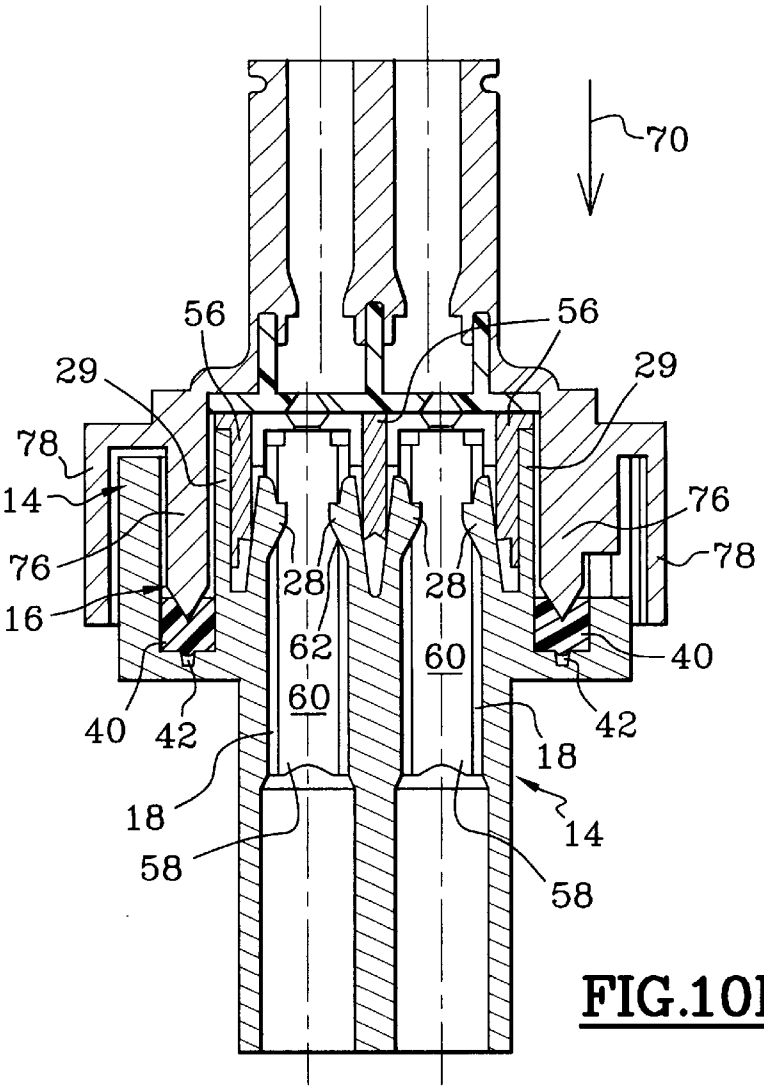
Figure 10A:
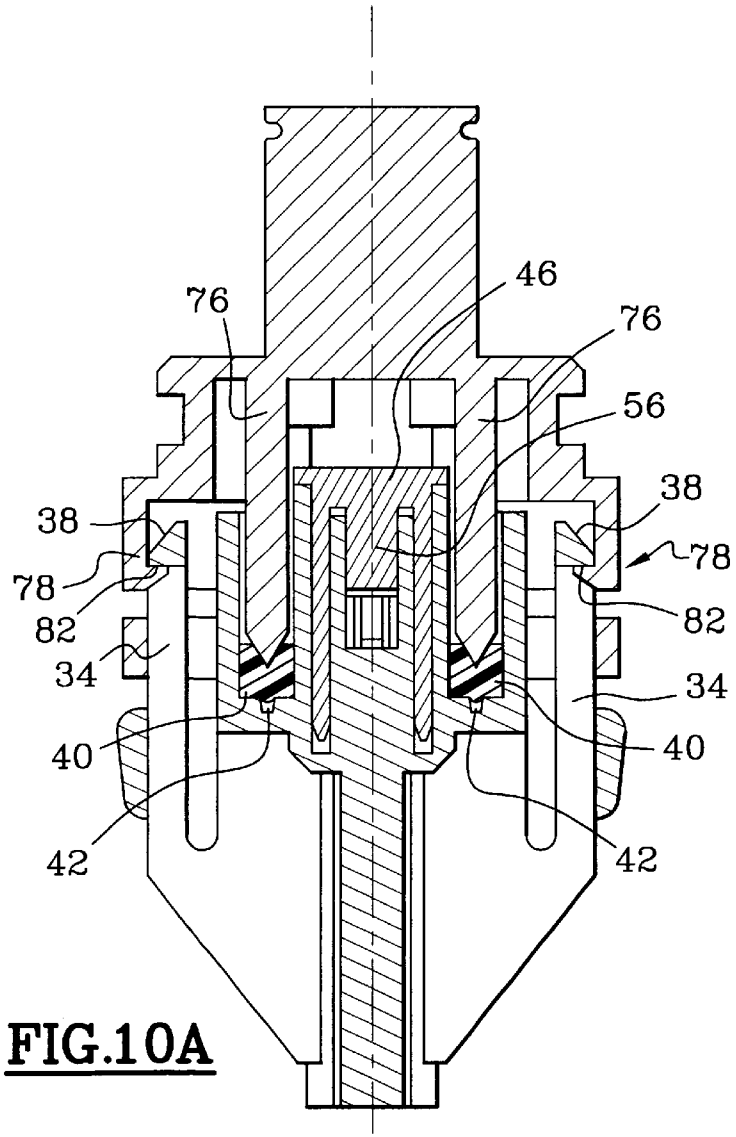

The connector is then adapted to receive a plug 72 as shown in FIGS. 10A and 10B.

The plug 72 has a profile generally conjugated with that of the connector.

This plug comprises a body 74 which is prolonged by two coaxial walls 76 and 78, internally and externally, provided to engagement respectively within the throat 16 and with the outside of the skirt 14 of the connector.

The internal wall 76 has a bevelled end 80 on the one hand to facilitate introduction into the throat 16 and on the other hand to bear against the joint 40 so as to effect the deformation of this joint, which takes the hollow form shown in FIGS. 10A and 10B. Thus, under the exerted pressure, the joint deforms and bends slightly into the groove 42 provided for this purpose at the bottom of the throat.

There is not only contact but also the formation of a baffle which reinforces the sealing in the plane of the joint.

This internal wall thus covers the central body 12. It will be noted that this central internal wall, during introduction of the plug, cannot damage the end catches 28 which are protected by the protective covers 29 and generally by the front grill.

This grill serves also to guide the electrical contact blades of the plug, not shown for simplicity of the drawings, through the holes 48 provided in the front plate 46.

The external wall 78 comprises catches 82 adapted to coact with the windows 36 of the resilient tongues 34 of the skirt 14 of the connector.

The snap-in operation is facilitated by the fact that the plug is already guided by the internal and external walls. It thus suffices to exert a supplemental pressure to compress the joint 40 by the internal wall 76, until the catches hook into the windows 36. The bevel 38 permits easily spacing the catches 82 during introduction.

When the plug is to be withdrawn from the connector, it suffices to press on the projecting resilient tongues 34, toward the skirt, to disengage the catches 82. If needed, pulling on the two connector elements permits disconnection.

It will thus be seen that the joint 40, although pressed by the internal wall 76 of the plug, remains in place at the bottom of the throat 16, even if it is subjected to suction or adhesive effects with the plug. The joint is maintained in place by the bearing tongues 54 of the front grill 44.

The front grill 44 cannot be withdrawn during disengagement of the plug outside the connector because no element projects outside the profile of the central block 12 and the inserted positioning means 53 hold the grill. On the other hand, as may be needed, after disconnection of the plug, a specific pull on the front grill ensures its retraction into the pre-insertion position and permits freeing the female contacts.

As to the joint, the described example has a flat one, but it is possible to provide an identical arrangement with a sleeve type joint which would surround the central body. In this case, the internal portion of this sleeve should carry the bearing regions of the same type as the bearing zones 43 to receive the corresponding bearing tongues of the front grill.

What is claimed is:

1. Sealed electrical connector including a central body and a peripheral skirt separated by a throat having a seal disposed in the throat, wherein the connector comprises a frontal piece forming a front grill, the grill including a frontal plate having at least one hole adapted to permit the passage of contacts of a male plug, the frontal grill covering the central body and the grill having holding means for supporting the seal and maintaining it in position in the throat, the holding means being integrated within the contour of the central body.

2. Sealed electrical connector according to claim 1, wherein said holding means supporting at least one bearing tongue extending from said grill, said seal including at least one bearing region positioned to be opposite the bearing tongues after mounting.

3. Sealed electrical connector according to claim 2, wherein said seal is a flat seal.

4. Sealed electrical connector according to claim 2, wherein each of said bearing tongues is positioned immediately adjacent said seal and in addition provides for an expansion space.

5. Sealed electrical connector according to claim 1, wherein said throat includes at its bottom portion a groove.

6. Sealed electrical connector according to claim 1, wherein said frontal piece forming said from grill includes guide blades which coact with holes provided in said central body, the blades being provided with positioning means for pre-insertion and insertion actions.

7. Sealed electrical connector according to claim 6, wherein said positioning means include a snap-in tooth projecting from a resiliently deformable portion of at least one of said blades and including suitable recesses that are provided in the walls facing said holes.

8. Sealed electrical connector according to claim 1, wherein said central body includes at least one central recess each of said recesses adapted to receive a contact and retaining means having catches for said contacts in said recesses.

9. Sealed electrical connector according to claim 8, wherein said central body includes protective covers for the retention means with said catches.

10. Sealed electrical connector according to claim 8, wherein said front grill includes locking fingers adapted to press said catches against said contacts, in the insertion position of said grill into said central body.

* * * * *